US009587200B2

(12) United States Patent
Utaka et al.

(10) Patent No.: US 9,587,200 B2
(45) Date of Patent: Mar. 7, 2017

(54) LUBRICANT COMPOSITION FOR INTERNAL COMBUSTION ENGINE

(71) Applicant: IDEMITSU KOSAN CO., LTD., Chiyoda-ku (JP)

(72) Inventors: Toshimasa Utaka, Chiba (JP); Hideki Kamano, Sodegaura (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 14/417,874

(22) PCT Filed: Jul. 30, 2013

(86) PCT No.: PCT/JP2013/070661
§ 371 (c)(1),
(2) Date: Jan. 28, 2015

(87) PCT Pub. No.: WO2014/021350
PCT Pub. Date: Feb. 6, 2014

(65) Prior Publication Data

US 2015/0175927 A1 Jun. 25, 2015

(30) Foreign Application Priority Data

Jul. 31, 2012 (JP) ..... 2012-170049

(51) Int. Cl.
*C10M 161/00* (2006.01)
*C10M 167/00* (2006.01)

(52) U.S. Cl.
CPC ..... *C10M 161/00* (2013.01); *C10M 167/00* (2013.01); *C10M 2203/1006* (2013.01); *C10M 2203/1025* (2013.01); *C10M 2207/028* (2013.01); *C10M 2207/262* (2013.01); *C10M 2207/289* (2013.01); *C10M 2209/084* (2013.01); *C10M 2215/064* (2013.01); *C10M 2215/28* (2013.01); *C10M 2219/046* (2013.01); *C10M 2219/068* (2013.01); *C10M 2223/045* (2013.01); *C10M 2227/066* (2013.01); *C10M 2227/09* (2013.01); *C10N 2210/06* (2013.01); *C10N 2230/02* (2013.01); *C10N 2230/06* (2013.01); *C10N 2230/10* (2013.01); *C10N 2230/54* (2013.01); *C10N 2230/68* (2013.01); *C10N 2230/74* (2013.01); *C10N 2240/10* (2013.01)

(58) Field of Classification Search
CPC ..... C10M 161/00; C10M 167/00; C10M 2203/1006; C10M 2203/1025; C10M 2207/028; C10M 2207/262; C10M 2207/289; C10M 2209/084; C10M 2215/064; C10M 2215/28; C10M 2219/046; C10M 2219/068; C10M 2223/045; C10M 2227/09; C10M 2227/66; C10N 2210/06; C10N 2230/02; C10N 2230/06; C10N 2230/10; C10N 2230/54; C10N 2230/68; C10N 2230/74; C10N 2240/10
USPC ..... 508/364, 391, 469, 531
See application file for complete search history.

(56) References Cited

U.S. PATENT DOCUMENTS

| | | | | |
|---|---|---|---|---|
| 6,562,765 | B1 * | 5/2003 | Boffa | C10M 163/00 508/221 |
| 2003/0134758 | A1 * | 7/2003 | Bovington | C10M 163/00 508/525 |
| 2005/0221998 | A1 | 10/2005 | Marumo et al. | |
| 2010/0093578 | A1 | 4/2010 | Tsujimoto et al. | |
| 2012/0071373 | A1 * | 3/2012 | Matsui | C10M 145/14 508/364 |
| 2012/0283159 | A1 | 11/2012 | Matsui et al. | |

FOREIGN PATENT DOCUMENTS

| | | | |
|---|---|---|---|
| EP | 2 177 596 | A1 | 4/2010 |
| EP | 2 439 257 | A1 | 4/2012 |
| EP | 2 873 720 | A1 | 5/2015 |
| JP | 2007-217494 | A | 8/2007 |
| JP | 2008-184569 | A | 8/2008 |
| JP | 2008-239774 | | 10/2008 |
| JP | 2008-248139 | A | 10/2008 |
| JP | 2008-303344 | A | 12/2008 |

(Continued)

OTHER PUBLICATIONS

International Search Report issued Nov. 5, 2013 in PCT/JP2013/070661 Filed Jul. 30, 2013.
Extended Search Report issued Apr. 8, 2016 in European Patent Application No. 13824983.4.
Office Action issued Oct. 4, 2016 in Japanese Patent Application No. 2014-528182.
Office Action issued Jan. 3, 2017 in Chinese Patent Application No. 201380040209.4.
Hou Fusheng; "China Refining Technology", China petrochemical Press (with English Translation).
Lei Wang, et al.; "Refining Technology"; 12th Five-year plan of the general higher education textbook (with English Translation).

*Primary Examiner* — James Goloboy
(74) *Attorney, Agent, or Firm* — Oblon, McClelland, Maier & Neustadt, L.L.P.

(57) ABSTRACT

A lubricating oil composition of the present invention for an internal combustion engine is prepared by blending (A) a perbasic calcium sulfonate and/or a perbasic calcium phenate having a TBN of 200 mgKOH/g or higher, (B) predetermined binuclear and/or trinuclear organic molybdenum compounds, and (C) a polyalkyl (meth)acrylate having an SSI of 30 or lower into a lubricating base oil composed of a mineral oil and/or a synthetic oil, in which the total content of molybdenum derived from the binuclear and trinuclear organic molybdenum compounds is 0.025% by mass or higher based on the total amount of the composition, and in which the lubricating oil composition has a high-temperature high-shear viscosity at 100° C. of 4.0 to 5.0 mPa·s, a high-temperature high-shear viscosity at 150° C. of 2.5 mPa·s or lower and a NOACK value (250° C., 1 hr) of 15% by mass or less.

20 Claims, No Drawings

(56) References Cited

FOREIGN PATENT DOCUMENTS

| | | | |
|---|---|---|---|
| JP | 2011-140573 | A | 7/2011 |
| JP | 2012-036344 | | 2/2012 |
| WO | WO 01/57166 | A1 | 8/2001 |

* cited by examiner

LUBRICANT COMPOSITION FOR INTERNAL COMBUSTION ENGINE

CROSS-REFERENCE TO RELATED APPLICATIONS

This application is a National Stage of PCT/JP2013/070661, which was filed on Jul. 30, 2013. This application is based upon and claims the benefit of priority to Japanese Application No. 2012-170049, which was filed on Jul. 31, 2012.

TECHNICAL FIELD

The present invention relates to a lubricating oil composition for an internal combustion engine, and more particularly to a lubricating oil composition for an internal combustion engine having a decreased viscosity.

BACKGROUND ART

In recent years, environmental regulations are becoming more and more stringent on a global scale. In particular, the circumstances surrounding automobiles, including fuel efficiency requirements and exhaust emission regulations, are becoming increasingly difficult. Behind this, there are environmental issues, such as global warming, and resource protection arising from concerns about the depletion of petroleum resources. For these reasons, it is believed that further reduction of fuel consumption in automobiles will be pursued. To reduce fuel consumption in automobiles, improvement of engine oil, such as reduction of viscosity thereof or addition of a good friction modifier for the purpose of reducing friction loss in an engine, is as important as improvement of automobiles per se, such as weight reduction of automobiles or engine improvement.

For example, Patent Document 1 discloses a lubricating oil composition for an internal combustion engine with a high-temperature high-shear viscosity at 150° C. of 2.6 mPa·s and a high-temperature high-shear viscosity at 100° C. of 5.5 to 5.9 mPa·s which is obtained by adding a polymethacrylate-based viscosity index improver, a salicylate-type metal detergent and a molybdenum-based friction modifier to a mineral oil-type base oil having a relatively low viscosity, enabling to improve fuel efficiency in an internal combustion engine.

PRIOR ART DOCUMENT

Patent Document

Patent document 1: JP 2007-217494 A

SUMMARY OF THE INVENTION

Problems to be Solved by the Invention

By the way, in recent years the demand for reduction of fuel consumption is further increasing because of environmental regulations and so on, and therefore, further reduction of viscosity of lubricating oils used in internal combustion engines, such as gasoline engines, diesel engines and gas engines, that comply with environmental regulations is under consideration.

However, for example if the viscosity of a lubricating oil is further decreased while utilizing the formulation of Patent Document 1 without modifying, the fuel efficiency, in particular the fuel efficiency at low engine rotation, cannot be sufficiently improved. On the contrary, some problems, such as an increase of wear of sliding members and a decrease in high-temperature oxidation stability, can occur.

The present invention has been made in view of the above circumstances, and therefore, it is an object of the present invention to improve the fuel consumption reducing effect, wear prevention effect and high-temperature oxidation stability of a lubricating oil composition used for an internal combustion engine and having a decreased viscosity.

Means for Solving the Problems

The inventors of the present invention conducted intensive studies to solve the above-mentioned problem. As a result, the inventors found that the problem can be overcome by blending a specific metal-based detergent, a specific organic molybdenum compound and a specific viscosity index improver in a lubricating oil composition for an internal combustion engine having a decreased viscosity, and accomplished the present invention described below.

Namely, the present invention provides the following (1) to (3).

(1) A lubricating oil composition for an internal combustion engine, prepared by blending:

(A) a perbasic calcium sulfonate and/or a perbasic calcium phenate having a total base number, as measured by a perchloric acid method, of 200 mgKOH/g or higher;

(B) a binuclear organic molybdenum compound represented by general formula (I) and/or a trinuclear organic molybdenum compound represented by general formula (II); and (C) a polyalkyl (meth)acrylate having an SSI (shear stability index) of 30 or lower, into a lubricating base oil composed of a mineral oil and/or a synthetic oil, in which the total content of molybdenum derived from the binuclear and trinuclear organic molybdenum compounds is 0.025% by mass or higher based on the total amount of the composition, and in which the lubricating oil composition has a high-temperature high-shear viscosity at 100° C. of 4.0 to 5.0 mPa·s, a high-temperature high-shear viscosity at 150° C. of 2.5 mPa·s or lower and a NOACK value (250° C., 1 hr) of 15% by mass or less;

[Chemical Formula 1]

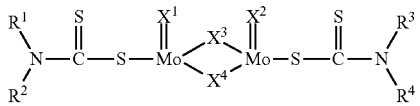

(I)

(wherein $R^1$ to $R^4$ represent a $C_4$ to $C_{22}$ hydrocarbon group and may be identical to or different from each other, and $X^1$ to $X^4$ each represents a sulfur atom or oxygen atom))

$$Mo_3S_kL_nQ_z \quad \text{(II)}$$

(wherein L's each independently represents a ligand having an organic group containing a carbon atom and at least 21 carbon atoms are present in total in all the organic groups of the ligands; n is from 1 to 4; k is from 4 to 7; Q represents a neutral electron donating compound; and z is from 0 to 5 and includes non-stoichiometric values).

(2) The lubricating oil composition for an internal combustion engine according to (1), in which organic molybdenum compound is blended in an amount of 0.04 to 0.1% by mass in terms of molybdenum content based on the total amount of the composition.

(3) The lubricating oil composition for an internal combustion engine according to (1) or (2), in which the polyalkyl (meth)acrylate is blended in an amount of 2 to 20% by mass based on the total amount of the composition.

Effect of the Invention

According to the present invention, it is possible to improve the fuel consumption reducing effect, wear prevention effect and high-temperature oxidation stability of a lubricating oil composition for an internal combustion engine having a decreased viscosity.

EMBODIMENTS OF THE INVENTION

A preferred embodiment of the present invention is hereinafter described in detail.

[Lubricating Oil Composition for Internal Combustion Engine]

A lubricating oil composition for an internal combustion engine (which may be hereinafter referred to simply as "lubricating oil composition") according to this embodiment is prepared by blending (A) a perbasic calcium sulfonate and/or a perbasic calcium phenate as a metal-based detergent, (B) organic molybdenum compound containing at least a binuclear organic molybdenum compound and/or a trinuclear organic molybdenum compound as a friction modifier, and (C) a polyalkyl (meth)acrylate as a viscosity index improver into a lubricating base oil.

The lubricating oil composition has a high-temperature high-shear viscosity (HTHS viscosity) at 150° C. of 2.5 mPa·s or lower, and a high-temperature high-shear viscosity (HTHS viscosity) at 100° C. of 4.0 to 5.0 mPa·s. When the lubricating oil composition has HTHS viscosities at 150° C. and 100° C. in the above ranges, the fuel consumption reducing effect of the lubricating oil composition can be improved easily.

The HTHS viscosity at 150° C. is preferably 2.0 to 2.5 mPa·s, more preferably 2.2 to 2.5 mPa·s. The HTHS viscosity at 100° C. is preferably 4.0 to 4.75 mPa·s.

The lubricating oil composition has a NOACK value (250° C., 1 hr) of 15% by mass or less. When the NOACK value is greater than 15% by mass, the lubricating oil composition has poor high-temperature oxidation stability and thus tends to undergo an increase in viscosity and so on. The NOACK value (250° C., 1 hr) is preferably 10% by mass or greater for improvement of fuel consumption reducing effect.

[Lubricating Base Oil]

The lubricating base oil used in the present invention is not particularly limited, and any mineral oil or synthetic oil conventionally used as a lubricating base oil can be appropriately selected and used.

Examples of the mineral oil include a mineral oil refined by subjecting a lubricating oil distillate that is obtained by distilling under a reduced pressure the atmospheric residue given by atmospheric distillation of crude oil, to one or more treatments selected from solvent deasphalting, solvent extraction, hydro-cracking, solvent dewaxing, catalytic dewaxing, hydrorefining, and the like, and a mineral oil produced by isomerization of wax or GTL WAX and the like.

Examples of the synthetic oil include polybutene, polyolefins such as α-olefin homopolymers and copolymers (e.g., ethylene-α-olefin copolymers), various kinds of esters such as polyol esters, dibasic acid esters, and phosphate esters, various kinds of ethers such as polyphenyl ethers, polyglycols, alkylbenzenes, and alkylnaphthalenes. Of those synthetic oils, polyolefins and polyol esters are particularly preferred.

In the present invention, the above mineral oils may be used singly or in combination of two or more kinds as the base oil. Alternatively, the above synthetic oils may be used singly or in combination of two or more kinds as the base oil. Further, one or more kinds of the mineral oils and one or more kinds of the synthetic oils may be used in combination as the base oil.

Although the viscosity of the lubricating base oil is not particularly limited, the lubricating base oil preferably has a kinematic viscosity at 100° C. in the range of 2.0 to 10 $mm^2/s$, more preferably in the range of 2.2 to 6.5 $mm^2/s$.

When the kinematic viscosity at 100° C. is adjusted to the above range, the viscosity of the lubricating oil composition can be decreased easily and the HTHS viscosities at 100° C. and 150° C. of the lubricating oil composition can be easily adjusted to the predetermined range as described above.

In addition, the lubricating base oil has a viscosity index of 100 or higher, more preferably 120 or higher, much more preferably 130 or higher. When the lubricating base oil has a viscosity index as high as 100 or higher, the change in viscosity of the lubricating base oil with change in temperature will be small.

The lubricating base oil preferably has a % Cp as measured by ring analysis of 75% or higher, more preferably 80% or higher, much more preferably 85% or higher. When the % Cp is 75% or higher, the lubricating composition can have high-temperature oxidation stability. The term "% Cp as measured by ring analysis" refers to a proportion (percentage) of paraffin components calculated by the ring analysis n-d-M method and is measured according to ASTM D-3238.

[Component (A)]

The perbasic calcium sulfonate and/or perbasic calcium phenate that is blended into the lubricating base oil of the present invention has a TBN of 200 mgKOH/g or higher. The TBN is a total base number measured according to JIS K-2501: perchloric acid method.

The total base number (TBN) of the component (A) is preferably 200 to 500 mgKOH/g, more preferably 300 to 450 mgKOH/g. A TBN of lower than 200 mgKOH/g results in an insufficient fuel consumption reducing effect. A TBN of 500 mgKOH/g or lower is preferred because the oxidation stability improves.

In addition, it is effective to use a neutral calcium sulfonate that has a TBN of 30 mgKOH/g or lower in combination with the above from the standpoint of improving the oxidation stability.

The perbasic calcium phenate is usually obtained by overbasing a calcium salt of a phenol, such as an alkylphenol or sulfurized alkylphenol, having a $C_1$ to $C_{50}$, preferably $C_{10}$ to $C_{30}$ alkyl group.

As the perbasic calcium sulfonate, calcium salts of various types of sulfonic acids can be used, and they are usually obtained by a method of carbonating calcium salts of various types of sulfonic acids. Examples of the sulfonic acids include aromatic petroleum sulfonic acids, alkylsulfonic acids, arylsulfonic acids and alkylarylsulfonic acids. Specific examples include dodecylbenzenesulfonic acid, dilaurylcetylbenzenesulfonic acid, paraffin wax-substituted benzenesulfonic acid, polyolefin-substituted benzenesulfonic acid, polyisobutylene-substituted benzenesulfonic acid and naphthalenesulfonic acid.

In the present invention, even when the perbasic calcium sulfonate and/or perbasic calcium phenate are used in combination with the binuclear and/or trinuclear organic molybdenum compounds as described later in the lubricating oil composition having a decreased viscosity, the high-temperature oxidation stability is not decreased and thus an increase in viscosity and so on can be prevented.

The perbasic calcium sulfonate and/or perbasic calcium phenate having a TBN of 200 mgKOH/g or higher are preferably blended in an amount of 0.5 to 5.0% by mass, more preferably 1.0 to 3.0% by mass, based on the total amount of the composition. The perbasic calcium sulfonate and/or perbasic calcium phenate can fulfill a function as a detergent when added in an amount of 0.5% by mass or greater, and fulfills a function corresponding to the blending amount when the amount is 5.0% by mass or less.

[Component (B)]

The organic molybdenum compound as the component (B) includes a binuclear organic molybdenum compound and/or a trinuclear organic molybdenum compound. In the present invention, the binuclear organic molybdenum compound is represented by general formula (I) below, and the trinuclear organic molybdenum compound is represented by general formula (II) below.

[Chemical Formula 2]

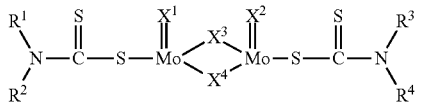

(I)

In formula (I), $R^1$ to $R^4$ represent a $C_4$ to $C_{22}$ hydrocarbon group, and $R^1$ to $R^4$ may be identical to or different from each other. When the number of carbon atoms is 3 or less, the binuclear organic molybdenum compound has poor oil solubility. When the number of carbon atoms is 23 or more, the binuclear organic molybdenum compound has such a high melting point that it is difficult to handle and has poor friction-reducing ability. From the above standpoint, the number of carbon atoms is preferably 4 to 18, more preferably 8 to 13. Examples of the hydrocarbon group include alkyl group, alkenyl group, alkylaryl group, cycloalkyl group and cycloalkenyl group. A branched or linear alkyl or alkenyl group is preferred, and a branched or linear alkyl group is more preferred. Examples of the $C_8$ to $C_{13}$ branched or linear alkyl group include n-octyl group, 2-ethylhexyl group, isononyl group, n-decyl group, isodecyl group, dodecyl group, tridecyl group and isotridecyl group. From the standpoint of solubility in the base oil, storage stability and friction-reducing ability, it is preferred that $R^1$ and $R^2$ be identical alkyl groups, $R^3$ and $R^4$ be identical alkyl groups, and the alkyl groups of $R^1$ and $R^2$ and the alkyl groups of $R^3$ and $R^4$ be different.

In formula (I), $X^1$ to $X^4$ represent a sulfur atom or oxygen atom, and $X^1$ to $X^4$ may be identical to or different from each other. In formula (I), the ratio between the sulfur atoms and oxygen atoms is preferably sulfur atom/oxygen atom=1/3 to 3/1, more preferably 1.5/2.5 to 3/l. When the ratio is in the above range, good performance can be achieved in terms of corrosion resistance and solubility in the base oil. All of $X^1$ to $X^4$ may be a sulfur atom or oxygen atom.

$$Mo_3S_kL_nQ_z \quad \text{(II)}$$

In general formula (II), L's each independently represents a selected ligand having an organic group containing carbon atoms; n is from 1 to 4; k varies between 4 and 7; Q's are each independently selected from the group consisting of neutral electron donating compounds, such as water, amines, alcohols, ethers and so on; and z ranges from 0 to 5 and includes non-stoichiometric values. At least 21 carbon atoms, such as at least 25 carbon atoms, at least 30 carbon atoms or at least 35 carbon atoms, should be present in total in all the organic groups of the ligands to render the above compound oil-soluble.

The ligands are selected from the group consisting of the following ligands and mixtures thereof, for example.

[Chemical Formula 3]

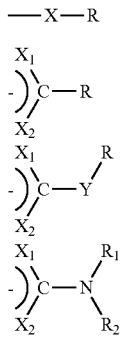

In these formulae, X, $X_1$, $X_2$ and Y are each independently selected from the group consisting of oxygen and sulfur, and $R_1$, $R_2$ and R are independently selected from hydrogen and organic groups and may be identical to or different from each other.

Preferably, the above organic groups are hydrocarbyl groups, such as alkyl, aryl, substituted aryl and ether groups (in which the carbon atom bonded directly to the remainder of the ligand is primary or secondary, for example). More preferably, each ligand has the same hydrocarbyl group.

The term "hydrocarbyl" refers to a substituent having a carbon atom directly bonded to the remainder of the ligand, and is predominantly hydrocarbyl in character in the scope of the present invention. Such substituents include the following:

1. Hydrocarbon substituents, that is, aliphatic substituents (for example, alkyl or alkenyl), alicyclic substituents (for example, cycloalkyl or cycloalkenyl), aromatic-, aliphatic- and alicyclic-substituted aromatic nuclei and the like, as well as cyclic groups in which the ring is completed through another portion of the ligand (that is, any two indicated substituents may together form an alicyclic group).
2. Substituted hydrocarbon substituents, that is, those containing a non-hydrocarbon group that does not alter the predominantly hydrocarbyl character of the substituent in the scope of the present invention. Examples of the non-hydrocarbon group include halo such as chloro and fluoro, amino, alkoxy, mercapto, alkylmercapto, nitro, nitroso and sulfoxy.

What is important is that the organic groups of the ligands have a sufficient number of carbon atoms to impart oil solubility to the above compound. For example, the number of carbon atoms in each group generally ranges between 1 and about 100, preferably between 1 and 30, more preferably between 4 and 20. Preferred ligands include alkylxanthate salts, carboxylate salts, dialkyldithiocarbamate salts, and mixtures thereof. Most preferred are dialkyldithiocarbamate salts. Those skilled in the art will recognize that the formation of the above compounds require selection of ligands having an appropriate charge to balance the core's charge (as discussed below).

Compounds having the formula $Mo_3S_kL_nQ_z$ have cationic cores surrounded by an ionic ligands, and the cationic cores are represented by structures having net charges of +4 as shown below.

[Chemical Formula 4]

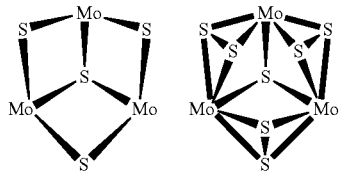

Thus, in order to solubilize these cores, the total charge among all the ligands must be −4. Four monoanionic ligands are preferred. Without wishing to be bound by any theory, two or more trinuclear cores may be bonded to one or more ligands or interconnected by one or more ligands, and the ligands may be polyvalent (i.e., have multiple connections to one or more cores). Oxygen and/or selenium may be substituted for sulfur in the cores.

Oil-soluble trinuclear organic molybdenum compounds are preferred. One oil-soluble trinuclear organic molybdenum compound can be prepared by reacting in an appropriate liquid/solvent a molybdenum source, such as $(NH_4)_2M_3S_{13}.n(H_2O)$ (wherein n varies between 0 and 2 and includes non-stoichiometric values) with an appropriate ligand source, such as tetralkylthiuram disulfides. Another oil soluble trinuclear molybdenum compound can be formed by reacting in an appropriate solvent a molybdenum source, such as $(NH_4)_2Mo_3S_{13}.n(H_2O)$, a ligand source, such as tetralkylthiuram disulfides or dialkyldithiocarbamic acid, and a sulfur-abstracting agent, such as cyanide ions or sulfite ions. Alternatively, a trinuclear molybdenum-sulfur halide salt, such as $[M']_2[Mo_3S_7A_6]$ (wherein M' is a counter ion, and A is a halogen, such as Cl, Br, or I) may be reacted with a ligand source, such as dialkyldithiocarbamic acid, in an appropriate liquid/solvent to form an oil-soluble trinuclear molybdenum compound. The appropriate liquid/solvent may be, for example, aqueous or organic.

The selected ligand must have a sufficient number of carbon atoms to render the above compound soluble in the lubricating oil composition. The term "oil-soluble" as used in the specification does not necessarily mean that the compounds or additives are fully soluble in the oil. It does mean that they are soluble in use, transportation, and storage.

When the binuclear and/or trinuclear organic molybdenum compounds are used together with the above-mentioned specific metal-based detergent (component (A)) and a specific viscosity index improver (component (C)) which is described later, in a lubricating oil composition having a low HTHS viscosity value as in the present invention, friction characteristics can be improved and reduction of fuel consumption can be achieved with the high-temperature oxidation stability maintained.

In the present invention, the total content of molybdenum derived from the binuclear and trinuclear organic molybdenum compounds in the lubricating oil composition is 0.025% by mass or higher based on the total amount of the composition. When the content is less than 0.025% by mass, the driving torque at low engine rotation increases, making it difficult to achieve the reduction of fuel consumption. In addition, when the content is less than 0.025% by mass, the driving torque at low engine rotation cannot be reduced even when an organic molybdenum compound other than the binuclear and trinuclear organic molybdenum compounds such as a mononuclear organic molybdenum shown below is added to increase the molybdenum content in the composition.

The lubricating oil composition may be prepared by further blending a mononuclear organic molybdenum compound therein in addition to the above-mentioned binuclear and/or trinuclear organic molybdenum compounds. The mononuclear organic molybdenum compound could not help to reduce the driving torque at low engine speed even when used singly, but when it is used together with the above-mentioned binuclear and/or trinuclear organic molybdenum compounds, the mononuclear organic molybdenum compound can help to reduce driving torque at low engine rotation to improve the fuel consumption reducing effect and can improve the high-temperature oxidation stability sufficiently to prevent an increase in viscosity.

Examples of the mononuclear organic molybdenum compound include a mononuclear organic molybdenum compound containing a compound of general formula (III) and/or a compound of general formula (IV). A mixture of the compounds of general formula (III) and general formula (IV) can be obtained by successively reacting a fatty oil with diethanolamine and a molybdenum source according to a condensation method disclosed in JP Sho 62-108891 A, for example.

[Chemical Formula 5]

(III)

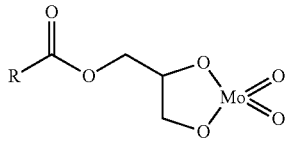

[Chemical Formula 6]

(IV)

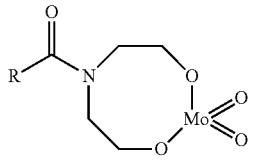

In formulae (III) and (IV), R represents a fatty oil residue, and the fatty oil is a glycerol ester of a higher fatty acid which contains at least 12 carbon atoms and may contain 22 or more carbon atoms. Such esters are generally known as vegetable and animal oils and fats. Examples of the useful vegetable oils and fats are derived from coconut, corn, cotton seeds, linseed oil, peanuts, soybeans and sunflower kernels. Similarly, animal oils and fats, such as tallow, may be used.

The molybdenum source may be an oxygen-containing molybdenum compound capable of reacting with an intermediate reaction product of the fatty oil and the diethanolamine to form an ester-type molybdenum complex. The molybdenum sources include, among others, ammonium molybdate, molybdenum oxide and mixtures thereof.

Other mononuclear organic molybdenum compounds that can be used include a compound obtained by reacting a hexavalent molybdenum compounds such as molybdenum trioxide and/or molybdic acid, with an amine compound; for example a compound that can be obtained by a production method described in JP 2003-252887 A. The amine compound to be reacted with the hexavalent molybdenum compound is not particularly limited, and there may be mentioned monoamines, diamines, polyamines and alkanol amines. Specific examples of the amine compound include alkyl amines having an $C_1$ to $C_{30}$ alkyl group (s) (the alkyl group may be either linear or branched) such as methylamine, ethylamine, dimethylamine, diethylamine, methylethylamine, and methylpropylamine; alkenyl amines containing a $C_2$ to $C_{30}$ alkenyl group (s) (the alkenyl group may be linear or branched) such as ethenyl amine, propenyl amine, butenyl amine, octenyl amine and oleyl amine; alkanol amines containing a $C_1$ to $C_{30}$ alkanol group(s) (the alkanol group may be linear or branched) such as methanol amine, ethanol amine, methanolethanolamine, and methanolpropanolamine; alkylene diamines containing a $C_1$ to $C_{30}$ alkylene group(s) such as methylenediamine, ethylenediamine, propylenediamine and butylenediamine; polyamines such as diethylenetriamine, triethylenetetramine, tetraethylenepentamine and pentaethylenehexamine; compounds, such as undecyldiethylamine, undecyldiethanol amine, dodecyldipropanol amine, oleyldiethanol amine, oleylpropylenediamine and stearyltertraethylenepentamine, which are the above monoamines, diamines or polyamines into which a $C_8$ to $C_{20}$ alkyl or alkenyl group (s) is further introduced; heterocyclic compounds such as imidazoline; alkyleneoxide adducts of these compounds; and mixtures of these compounds.

The sulfur-containing molybdenum complex of a succinimide described in JP Hei 3-22438 B and JP 2004-2866 A is also exemplified as a mononuclear organic molybdenum compound.

In the lubricating oil composition of the present invention, organic molybdenum compound is preferably blended in an amount of 0.04 to 0.1% by mass, more preferably 0.05 to 0.09% by mass, in terms of total molybdenum content based on the total amount of the composition. When the content is 0.04% by mass or higher, the friction-reducing properties can be improved to achieve a fuel consumption reducing effect. When the content is 0.1% by mass or lower, it is possible to enable the organic molybdenum compounds to produce an effect corresponding to the amount added.

Of this content, the total content of molybdenum derived from the mononuclear organic molybdenum compound is preferably 0.075% by mass or lower, more preferably 0.015 to 0.07% by mass, especially preferably 0.05 to 0.07% by mass, based on the total amount of the composition. When the content of molybdenum derived from the mononuclear organic molybdenum compound is in this range, the use of the mononuclear organic molybdenum compound together with the binuclear and/or trinuclear organic molybdenum compounds can sufficiently improve the friction reducing properties of the lubricating oil composition.

In addition, when the mononuclear organic molybdenum compound and the binuclear and/or trinuclear organic molybdenum compounds are used in combination, the high-temperature oxidation stability and the friction reducing properties can be improved and the reduction of fuel consumption can be achieved even if the amount of the binuclear and trinuclear organic molybdenum compounds to be added is reduced until the content of molybdenum derived from them is smaller than the content of molybdenum derived from the mononuclear organic molybdenum compound, for example. Specifically, the total content of molybdenum derived from the binuclear and trinuclear organic molybdenum compounds may be in the range of 0.025 to 0.05% by mass approximately when the binuclear and trinuclear organic molybdenum compounds are used in combination with the mononuclear organic molybdenum compound.

On the other hand, when no mononuclear organic molybdenum compound is used, it is better to increase the amount of the binuclear and trinuclear organic molybdenum compounds to be added until the total content of molybdenum derived from them reaches 0.040% by mass or higher, preferably 0.04 to 0.1% by mass, more preferably 0.05 to 0.09% by mass.

[Component (C)]

As the component (C) blended in the lubricating oil composition, a polyalkyl (meth)acrylate having an SSI of 30 or lower is used. The terms "SSI" means shear stability index, which represents the ability of a polymer (component (C)) to resist decomposition. As the SSI is higher, the polymer is more unstable and decomposed more easily under shear.

$$SSI = \frac{Kv_0 - Kv_1}{Kv_0 - Kv_{oil}} \times 100$$ [Mathematical Formula 1]

The SSI is an indication of the decrease in viscosity under shear derived from the polymer in percentage, and is calculated using the above calculation formula. In the formula, $Kv_0$ represents the value of kinematic viscosity at 100° C. of a mixture of a base oil and a polyalkyl (meth)acrylate. $Kv_1$ represents the value of kinematic viscosity at 100° C. measured after the mixture of the base oil and the polyalkyl (meth)acrylate added thereto is passed through a high-shear Bosch diesel injector for 30 cycles according to the procedure of ASTM D6278. $Kv_{oil}$ denotes the value of kinematic viscosity at 100° C. of the base oil. As the base oil, a Group II base oil having a kinematic viscosity at 100° C. of 5.35 $mm^2/s$ and a viscosity index of 105 is used.

In the present invention, the wear prevention properties of the lubricating oil composition can be improved by using a polyalkyl (meth)acrylate having an SSI of 30 or lower as a viscosity index improver. In addition, the use of the polyalkyl (meth)acrylate together with the above-mentioned specific metal-based detergent and friction modifier (components (A) and (B)) can improve not only the high-temperature oxidation stability but also the fuel consumption reducing effect of the lubricating oil composition.

The SSI of the component (C) is preferably 1 to 25. When the SSI is 25 or lower, the lubricating oil composition can have better wear prevention properties.

The monomer that constitutes the polyalkyl (meth)acrylate of the component (C) is an alkyl (meth) acrylate, and is preferably an alkyl (meth)acrylate of a $C_1$ to $C_{18}$ linear alkyl group or a $C_3$ to $C_{34}$ branched alkyl group.

Examples of preferred monomers that constitute the alkyl (meth)acrylate include methyl (meth)acrylate, ethyl (meth) acrylate, propyl (meth)acrylate, butyl (meth)acrylate, pentyl (meth)acrylate, hexyl (meth)acrylate, hexyl (meth)acrylate, heptyl (meth)acrylate, octyl (meth)acrylate, nonyl (meth) acrylate and decyl (meth)acrylate. Two or more kinds of these monomers may be used to form a copolymer. The alkyl group of these monomers may be linear or branched.

The polyalkyl (meth) acrylate preferably has a weight-average molecular weight of 10,000 to 1,000,000, more preferably 30,000 to 500,000. When the polyalkyl (meth) acrylate has a molecular weight in this range, its SSI can be easily adjusted to 30 or lower.

The weight-average molecular weight is a value measured by GPC using polystyrene as a calibration curve. Specifically, the weight-average molecular weight is measured under the following conditions.

Columns: two TSK gel GMH6 columns
Measurement temperature: 40° C.
Sample solution: 0.5% by mass THF solution
Detector: refractive index detector
Standard: polystyrene In the lubricating oil composition, the polyalkyl (meth) acrylate having an SSI of 30 or lower is preferably blended in an amount of 2 to 20% by mass, more preferably 5 to 15% by weight, based on the total amount of the composition. When the component (C) is blended in an amount in these ranges, the viscosity of the lubricating oil composition can be easily adjusted to a desired value.

[Other Components]

The lubricating oil composition may be prepared by further blending other components therein in addition to the components (A) to (C). Examples of the other components include friction modifiers that also function as antioxidants, such as zinc dialkyldithiophosphates, various types of antioxidants, ashless dispersants, ashless friction modifiers, metal deactivators, pour-point depressants and antifoaming agents.

As the zinc dialkyldithiophosphates, zinc dialkyldithiophosphates having a $C_3$ to $C_{22}$ primary or secondary alkyl group or an alkylaryl group substituted by a $C_3$ to $C_{18}$ alkyl group can be used. These compounds may be used singly or in combination of two or more kinds.

As the antioxidants that can be blended in the lubricating oil composition, there may be mentioned amine-based antioxidants, phenol-based antioxidants, sulfur-based antioxidants, phosphorus-based antioxidants, and so on. Any appropriate antioxidant selected from known antioxidants which are conventionally used as antioxidants for lubricating oils may be used.

As the amine-based antioxidants, there may be mentioned diphenylamine-based antioxidants, such as diphenylamine and alkylated diphenylamines having a $C_3$ to $C_{20}$ alkyl group; naphthylamine-based antioxidants, such as α-naphthylamine, $C_3$ to $C_{20}$ alkyl substituted phenyl-α-naphthylamines, and so on.

As the phenol-based antioxidants, there may be mentioned monophenol-based antioxidants, such as 2,6-di-tert-butyl-4-methylphenol, 2,6-di-tert-butyl-4-ethylphenol, and octadecyl-3-(3,5-di-tert-butyl-4-hydroxyphenyl) propionate; diphenol-based antioxidants, such as 4,4'-methylenebis (2,6-di-tert-butylphenol) and 2,2'-methylenebis (4-ethyl-6-tert-butylphenol), and so on.

As the sulfur-based antioxidant, there may be mentioned dilauryl-3,3'-thiodipropionate, and so on. As the phosphorus-based antioxidants, there may be mentioned phosphites, and so on.

These antioxidants may be used singly or in any combination of two or more kinds, and a combined use of two or more kinds is usually preferred.

As the ashless dispersants, there may be mentioned polybutenyl succinimide, polybutenyl benzylamine and polybutenylamine, each of which has a polybutenyl group having a number average molecular weight of 900 to 3,500, and derivatives of these such as boric acid-modified products of these compounds, and soon. These ashless dispersants may be blended singly or in any combination of two or more kinds.

As the ashless friction modifiers, ester-based friction modifiers, such as a partial ester compound obtained by the reaction of a fatty acid with an aliphatic polyhydric alcohol, can be used for example. The fatty acid is preferably a fatty acid having linear or branched hydrocarbon group whose carbon number is 6 to 30, and the carbon number of the hydrocarbon group is preferably 8 to 24, especially preferably 10 to 20. The aliphatic polyhydric alcohol is a dihydric to hexahydric alcohol, examples of which include ethylene glycol, glycerin, trimethylolpropane, pentaerythritol and sorbitol.

As the metal deactivators, there may be mentioned benzotriazole, triazole derivatives, benzotriazole derivatives, thiadiazole derivatives, and so on.

As the pour-point depressants, there may be mentioned ethylene-vinyl acetate copolymers, condensation products of chlorinated paraffin and naphthalene, condensation products of chlorinated paraffin and phenol, polymethacrylates, polyalkylstyrenes, and so on. Especially preferred is the use of a polymethacrylate.

As the antifoaming agents, there may be mentioned dimethylpolysiloxanes, polyacrylates, and so on.

In this specification, the expression "prepared by blending component(s) (for example, components (A) to (C))" means the lubricating oil composition comprising the component(s) (the components (A) to (C)) by blending the component (s) (the components (A) to (C)) into the lubricating base oil, but also means at least some portions of the blended components (components (A) to (C)) have been reacted with each other and one or more of the components (A) to (C) and some of any blended component other than these components (components (A) to (C)) have been reacted with each other.

EXAMPLE

Although the following examples further describe the present invention in more detail, it should be noted that the present invention is by no means limited by those examples.

The properties of lubricating oil compositions and base oils shown in this specification were determined according to the following procedures.

(1) Kinematic Viscosity

The kinematic viscosity was measured using a glass capillary viscometer according to JIS K2283-1983.

(2) Viscosity Index

The viscosity index was measured according to JIS K 2283.

(3) NOACK Value

The NOACK value was measured according to the method specified in ASTM D5800.

(4) High-Temperature High-Shear Viscosity (HTHS Viscosity)

The high-temperature high-shear viscosity was measured by the method of ASTM D4683 and ASTM D6616 using a TBS viscometer (Tapered Bearing Simulator Viscometer). The test conditions are shown below.

Shear rate: $10^6$ $sec^{-1}$
Rotational speed (motor): 3000 rpm
Clearance (rotor/stator): 3 μm
Oil temperature: 100° C. and 150° C.

The methods for evaluating the lubricating oil compositions in the examples and comparative examples are as follows.

(1) Motoring Driving Torque

The camshaft of an SOHC engine with a 2 L displacement was driven by a motor using the lubricating oil composition of each Example and Comparative Example, and the torque that was applied to the camshaft at this time was measured. The measured value was evaluated as a motoring driving torque. The rotational speed of the camshaft and the engine oil temperature were adjusted to 550 rpm and 100° C., respectively.

(2) Wear Prevention Properties Test

The wear prevention properties of the lubricating oil composition was determined, according to ASTM D6287-07, by measuring the kinematic viscosity at 100° C. after applying shear to the lubricating oil composition 30 times in a diesel injector. As the kinematic viscosity at 100° C. is lower, the wear prevention properties are poorer.

(3) High-Temperature Oxidation Stability Test

The lubricating oil composition was subjected to high temperature oxidation according the method of NOACK (250° C., 4 hrs). The kinematic viscosities (40° C.) before and after the high temperature oxidation were measured, and the rate of increase in kinematic viscosity (40° C.) was measured.

Examples 1 to 6 and Comparative Examples 1 to 7

Lubricating oil compositions of examples and comparative examples were prepared according to the composition shown in Table 1, and the properties of the lubricating oil compositions were measured. The lubricating oil compositions of examples and comparative examples were evaluated according to the above-mentioned evaluation methods.

TABLE 1

| | | | Example | | | | | |
|---|---|---|---|---|---|---|---|---|
| | | | 1 | 2 | 3 | 4 | 5 | 6 |
| Formulation Composition (% by mass) | | Base oil A | balance | balance | balance | balance | balance | balance |
| | | Base oil B | — | — | — | — | — | — |
| | (A) | Metal-based detergent A | 1.80 | 1.80 | 1.80 | 1.80 | 1.80 | — |
| | | Metal-based detergent B | — | — | — | — | — | 2.15 |
| | | Metal-based detergent C | — | — | — | — | — | — |
| | (B) | Binuclear molybdenum compound | 0.70 | 0.70 | 0.40 | — | 0.25 | 0.70 |
| | | Trinuclear molybdenum compound | — | — | — | 1.33 | — | — |
| | | Mononuclear molybdenum compound (1) | — | — | — | — | 0.75 | — |
| | | Mononuclear molybdenum compound (2) | — | — | — | — | — | — |
| | (C) | Viscosity index improver A | 7.30 | 9.00 | 7.30 | 7.30 | 7.30 | 7.30 |
| | | Viscosity index improver B | — | — | — | — | — | — |
| | | ZnDTP | 1.00 | 1.00 | 1.00 | 1.00 | 1.00 | 1.00 |
| | | Amine-based antioxidant | 1.00 | 1.00 | 1.00 | 1.00 | 1.00 | 1.00 |
| | | Phenol-based antioxidant | 0.50 | 0.50 | 0.50 | 0.50 | 0.50 | 0.50 |
| | | Polybutenylbissuccinimide | 3.50 | 3.50 | 3.50 | 3.50 | 3.50 | 3.50 |
| | | Ester-based friction modifier | 0.30 | 0.30 | 0.30 | 0.30 | 0.30 | 0.30 |
| | | Other additives | 1.20 | 1.20 | 1.20 | 1.20 | 1.20 | 1.20 |
| Properties of Composition | | Kinematic viscosity (40° C.) ($mm^2/s$) | 29.25 | 30.63 | 29.20 | 30.05 | 30.75 | 30.06 |
| | | Kinematic viscosity (100° C.) ($mm^2/s$) | 6.719 | 7.157 | 6.699 | 6.819 | 6.919 | 6.799 |
| | | Viscosity index | 199 | 210 | 198 | 197 | 196 | 196 |
| | | HTHS viscosity (100° C.) (mPa · s) | 4.46 | 4.55 | 4.48 | 4.51 | 4.58 | 4.51 |
| | | HTHS viscosity (150° C.) (mPa · s) | 2.30 | 2.42 | 2.31 | 2.32 | 2.32 | 2.31 |
| | | NOACK (250° C., 1 hr) (% by mass) | 14.1 | 14.4 | 14.1 | 14.0 | 14.0 | 14.2 |
| | | Amount of Mo derived from binuclear and trinuclear Mo compounds (% by mass) | 0.070 | 0.070 | 0.040 | 0.070 | 0.025 | 0.070 |
| | | Amount of Mo derived from mononuclear Mo compound (% by mass) | — | — | — | — | 0.059 | — |
| | | Total Mo amount (% by mass) | 0.070 | 0.070 | 0.040 | 0.070 | 0.084 | 0.070 |
| | | Motoring driving torque (N · m) | 8.81 | 8.83 | 9.11 | 8.92 | 9.03 | 9.07 |
| | | Wear prevention properties test: kinematic viscosity at 100° C. ($mm^2/s$) | 6.11 | 6.48 | 6.10 | 6.20 | 6.30 | 6.15 |
| | | High-temperature oxidation stability test: rate of increase in kinematic viscosity (%) | 39 | 36 | 36 | 41 | 33 | 40 |

| | | | Comparative Example | | | | | | |
|---|---|---|---|---|---|---|---|---|---|
| | | | 1 | 2 | 3 | 4 | 5 | 6 | 7 |
| Formulation Composition (% by mass) | | Base oil A | balance | balance | balance | balance | balance | balance | balance |
| | | Base oil B | — | — | — | — | — | 35.00 | — |
| | (A) | Metal-based detergent A | 1.80 | 1.80 | 1.80 | 1.80 | 1.80 | 1.80 | — |
| | | Metal-based detergent B | — | — | — | — | — | — | — |
| | | Metal-based detergent C | — | — | — | — | — | — | 2.60 |
| | (B) | Binuclear molybdenum compound | 0.20 | — | — | — | 0.70 | — | 0.70 |
| | | Trinuclear molybdenum compound | — | — | — | — | — | — | — |
| | | Mononuclear molybdenum compound (1) | — | — | — | — | — | 0.70 | — |

TABLE 1-continued

| | | | | | | | | | |
|---|---|---|---|---|---|---|---|---|---|
| | | Mononuclear molybdenum compound (2) | — | — | — | 0.70 | — | — | — |
| | (C) | Viscosity index improver A | 7.15 | 7.15 | 11.50 | 7.15 | — | 11.00 | 7.15 |
| | | Viscosity index improver B | — | — | — | — | 2.95 | — | — |
| | | ZnDTP | 1.00 | 1.00 | 1.00 | 1.00 | 1.00 | 1.00 | 1.00 |
| | | Amine-based antioxidant | 1.00 | 1.00 | 1.00 | 1.00 | 1.00 | 1.00 | 1.00 |
| | | Phenol-based antioxidant | 0.50 | 0.50 | 0.50 | 0.50 | 0.50 | 0.50 | 0.50 |
| | | Polybutenylbissuccinimide | 3.50 | 3.50 | 3.50 | 3.50 | 3.50 | 3.50 | 3.50 |
| | | Ester-based friction modifier | 0.30 | 0.30 | 0.30 | 0.30 | 0.30 | 0.30 | 0.30 |
| | | Other additives | 1.20 | 1.20 | 1.20 | 1.20 | 1.20 | 1.20 | 1.20 |
| Properties of Composition | | Kinematic viscosity (40° C.) ($mm^2/s$) | 29.05 | 29.03 | 32.57 | 28.93 | 33.26 | 27.26 | 30.33 |
| | | Kinematic viscosity (100° C.) ($mm^2/s$) | 6.655 | 6.650 | 7.776 | 6.660 | 7.166 | 7.172 | 6.830 |
| | | Viscosity index | 197 | 197 | 222 | 199 | 187 | 247 | 195 |
| | | HTHS viscosity (100° C.) (mPa · s) | 4.46 | 4.46 | 4.68 | 4.46 | 4.89 | 4.16 | 4.53 |
| | | HTHS viscosity (150° C.) (mPa · s) | 2.29 | 2.29 | 2.60 | 2.29 | 2.30 | 2.32 | 2.30 |
| | | NOACK (250° C., 1 hr) (% by mass) | 14.1 | 14.0 | 14.5 | 14.0 | 13.9 | 23.5 | 14.2 |
| | | Amount of Mo derived from binuclear and trinuclear Mo compounds (% by mass) | 0.020 | — | — | — | 0.070 | — | 0.070 |
| | | Amount of Mo derived from mononuclear Mo compound (% by mass) | — | — | — | 0.070 | — | 0.055 | — |
| | | Total Mo amount (% by mass) | 0.020 | 0.000 | 0.000 | 0.070 | 0.070 | 0.055 | 0.070 |
| | | Motoring driving torque (N · m) | 15.63 | 16.12 | 14.83 | 14.65 | 8.90 | 8.80 | 8.77 |
| | | Wear prevention properties test: kinematic viscosity at 100° C. ($mm^2/s$) | 6.06 | 6.05 | 7.08 | 6.06 | 5.48 | 6.20 | 6.23 |
| | | High-temperature oxidation stability test: rate of increase in kinematic viscosity (%) | 34 | 33 | 32 | 34 | 36 | 78 | 85 |

*The components shown in Table 1 are as follows.

(1) Lubricating base oil

Base oil A: Group III 100 N hydrorefined base oil, kinematic viscosity at 100° C. 4.2 $mm^2/s$, viscosity index 132, NOACK value (250° C., 1 hr) 13.5% by mass, n-d-M ring analysis % Cp 85.5%

Base oil B: Group II 70 N hydrorefined base oil, kinematic viscosity at 100° C. 3.10 $mm^2/s$, viscosity index 103, NOACK value (250° C., 1 hr) 39.7% by mass, n-d-M ring analysis % Cp 71.0%

(2) Metal-based detergent (component (A))

Metal-based detergent A: perbasic calcium sulfonate, TBN (perchloric acid method) 300 mgKOH/g, calcium content 11.1% by mass, sulfur content 1.49% by mass Metal-based detergent B: perbasic calcium phenate, TBN (perchloric acid method) 255 mgKOH/g, calcium content 9.3% by mass, sulfur content 3.0% by mass Metal-based detergent C: perbasic calcium salicate , TBN (perchloric acid method) 225 mgKOH/g, calcium content 7.8% by mass, sulfur content 0.2% by mass (3) Organic molybdenum compound (component (B))

Binuclear molybdenum compound: trade name SAKURA-LUBE 515 (manufactured by ADEKA Corporation), binuclear molybdenum dithiocarbamate represented by general formula (I) (wherein $R^1$ to $R^4$ each has 8 or 13 carbon atoms, and $X^1$ to $X^4$ are oxygen atoms), molybdenum content 10.0% by mass, sulfur content 11.5% by mass Trinuclear molybdenum compound: trade name Infineum C9455B (manufactured by INFINEUM Ltd.), trinuclear molybdenum dithiocarbamate represented by general formula (II), molybdenum content 5.27% by mass, sulfur content 9.04% by mass Mononuclear molybdenum compound (1): trade name: MOLYVAN 855 (manufactured by R. T. Vanderbilt Company Inc.), mixture of [2,2'-(dedecanoylimino) diethanolato]dioxomolybdenum (VI) and [3-(dodecanoyloxy)-1,2-propanediolato] dioxomolybdenum (VI), molybdenum content 7.9% by mass, nitrogen content 2.8% by mass Mononuclear molybdenum compound (2): trade name SAKURA-LUBE S-710 (manufactured by ADEKA Corporation) , diisotridecylamine molybdate, molybdenum content 10.0% by mass (4) Viscosity index improver (component (C))

Viscosity index improver A: polyalkyl (meth)acrylate, mass average molecular weight 380,000, SSI = 20

Viscosity index improver B: polyalkyl (meth)acrylate, mass average molecular weight 420,000, SSI = 53

(5) Others

Zinc dialkyldithiophosphate (ZnDTP): zinc content 9.0% by mass, phosphorus content 8.2% by mass, sulfur content 17.1% by mass, alkyl group; mixture of a secondary butyl group and a secondary hexyl group Amine-based antioxidant: dialkyldiphenylamine, nitrogen content 4.62% by mass Phenol-based antioxidant: octadecyl-3-(3,5-di-tert-butyl-4-hydroxyphenyl) propionate Polybutenylbissuccinimide: number average molecular weight of polybutenyl group 2,300, nitrogen content 1.0% by mass, chlorine content 0.01% by mass or lower Ester-based friction modifier: glycerin monooleate As the other additives shown in Table 1, a metal deactivator, a pour-point depressant and an antifoaming agent were blended.

As is clear from the results shown in Table 1, the lubricating oil compositions of the examples, which had a decreased viscosity and reduced the motoring driving torque, were able to improve the fuel consumption reducing effect. In addition, as is clear from the results of the wear prevention properties test, the lubricating oil compositions were able to prevent wear caused by shear. Further, the lubricating oil compositions showed a low rate of increase (%) in kinematic viscosity under high temperature and were superior in high-temperature oxidation stability. In contrast, the lubricating oil compositions of the comparative examples, in which any one of the components (A) to (C) of the present invention was not blended or an amount of the component (B) was decreased, were inferior in any of fuel efficiency, wear prevention properties and high-temperature oxidation stability.

INDUSTRIAL APPLICABILITY

The lubricating oil composition of the present invention for an internal combustion engine is improved in fuel consumption reducing effect, wear prevention effect and high-temperature oxidation stability in spite of having a decreased viscosity, and can be used advantageously in internal combustion engines, especially in internal combustion engines having high fuel efficiency.

The invention claimed is:

1. A lubricating oil composition for an internal combustion engine, prepared by blending:

(A) 1.0 to 3.0% by mass of a perbasic calcium sulfonate, a perbasic calcium phenate, or both, having a total base number, as measured by a perchloric acid method, of 200 mg KOH/g to 500 mg KOH/g, relative to a total mass of the lubricating oil composition;

(B) a binuclear organic molybdenum compound represented by general formula (I) below, a trinuclear organic molybdenum compound represented by general formula (II) below, or both:

[Chemical Formula 1]

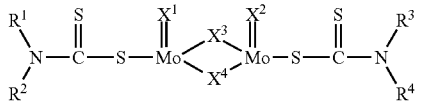

(I)

$Mo_3S_kL_nQ_z$ (II), (C) 5 to 15% by mass of a polyalkyl (meth)acrylate having an SSI ranging from 1 to 20; and (D) an amine antioxidant and a phenol antioxidant, relative to the total mass of the lubricating oil composition, into a lubricating base oil comprising at least one of a mineral oil and a synthetic oil, wherein:

a total content of molybdenum derived from the binuclear and trinuclear organic molybdenum compounds is 0.025% by mass or higher, and a content of all organic molybdenum compounds blended in the composition ranges from 0.04% to 0.1% by mass in terms of molybdenum content, based on the total amount of the composition;

the lubricating oil composition has a high-temperature high-shear viscosity at 100° C. of 4.0 to 5.0 mPa·s, a high-temperature high-shear viscosity at 150° C. of 2.0 to 2.5 mPa·s, and a NOACK value (250° C., 1 hr) of 15% by mass or less;

the lubricating oil composition exhibits all of the following properties a motor driving torque of less than or equal to 9.11 N·m when the lubricating oil composition is used to lubricate a single overhead cam engine with a 2 L displacement operating at a camshaft rotational speed of 550 rpm at lubricating oil temperature of 100° C., a kinematic viscosity at 100° C. of equal to or more than 6.10 $mm^2/s$ after applying a shear to the lubricating oil composition 30 times in a diesel injector, and a rate of increase in kinematic viscosity at 40° C. of less than or equal to 41% when the lubricating oil composition is subjected to high temperature oxidation according to the method NOACK (250° C., 4 hrs);

$R^1$ to $R^4$ represent a $C_4$ to $C_{22}$ hydrocarbon group and may be identical to or different from each other;

$X^1$ to $X^4$ each represents a sulfur atom or oxygen atom;

L independently represents a ligand having an organic group containing a carbon atom and at least 21 carbon atoms are present in total in all the organic groups of the ligands;

n is from 1 to 4;

k is from 4 to 7;

Q represents a neutral electron donating compound; and z is from 0 to 5 and includes non-stoichiometric values.

2. The lubricating oil composition according to claim 1, wherein the content of all organic molybdenum compounds blended in the composition ranges from 0.05% to 0.09% by mass in terms of the molybdenum content based on the total amount of the composition.

3. The lubricating oil composition according to claim 1, wherein the polyalkyl (meth)acrylate is blended in an amount of 7.3% to 9.0% by mass based on the total amount of the composition.

4. The lubricating oil composition according to claim 1, wherein the high-temperature high-shear viscosity at 150° C. ranges from 2.30 to 2.42 mPa·s.

5. The lubricating oil composition according to claim 1, wherein the high-temperature high-shear viscosity at 100° C. ranges from 4.0 to 4.75 mPa·s.

6. The lubricating oil composition according to claim 1, wherein the NOACK value (250° C., 1 hr) ranges from 10% by mass to 15% by mass.

7. The lubricating oil composition according to claim 1, the total content of molybdenum derived from the binuclear and trinuclear organic molybdenum compounds ranges from 0.025% to 0.1% by mass based on the total amount of the composition.

8. The lubricating oil composition according to claim 1, comprising the binuclear organic molybdenum compound represented by general formula (I).

9. The lubricating oil composition according to claim 1, comprising the trinuclear organic molybdenum compound represented by general formula (II).

10. The lubricating oil composition according to claim 1, comprising the binuclear organic molybdenum compound represented by general formula (I) and the trinuclear organic molybdenum compound represented by general formula (II).

11. The lubricating oil composition according to claim 1, wherein the lubricating base oil has a kinematic viscosity at 100° C. ranging from 2.0 to 10 $mm^2/s$.

12. The lubricating oil composition according to claim 1, wherein the lubricating base oil has a kinematic viscosity at 100° C. ranging from 2.2 to 6.5 $mm^2/s$.

13. The lubricating oil composition according to claim 1, wherein the lubricating base oil has a viscosity index of 100 or higher.

14. The lubricating oil composition according to claim 1, comprising the binuclear organic molybdenum compound represented by general formula (I), wherein $R^1$ to $R^4$ independently represent a $C_4$ to $C_{18}$ hydrocarbon group.

15. The lubricating oil composition according to claim 1, comprising the binuclear organic molybdenum compound represented by general formula (I), wherein $X^1$ to $X^4$ all represent an oxygen atom.

16. The lubricating oil composition according to claim 1, further comprising a mononuclear molybdenum compound, wherein a total content of molybdenum derived from the mononuclear molybdenum compound ranges from 0.015% to 0.07% by mass, relative to a total mass of the lubricating oil composition.

17. The lubricating oil composition according to claim 16, wherein the total content of the molybdenum derived from the binuclear and trinuclear organic molybdenum compounds ranges from 0.025% to 0.05% by mass based on the total amount of the composition.

18. The lubricating oil composition according to claim 1, wherein:

the lubricating oil composition does not contain a mononuclear organic molybdenum compound; and the total content of the molybdenum derived from the binuclear and trinuclear organic molybdenum compounds ranges from 0.04% to 0.1% by mass based on the total amount of the composition.

19. The lubricating oil composition according to claim 1, wherein the lubricating oil composition exhibits all of the following properties:

a motor driving torque ranging from 8.81 N·m to 9.11 N·m when the lubricating oil composition is used to lubricate a single overhead cam engine with a 2 L displacement operating at a camshaft rotational speed of 550 rpm at lubricating oil temperature of 100° C.;

a kinematic viscosity at 100° C. ranging from 6.10 to 6.48 $mm^2/s$ after applying a shear to the lubricating oil composition 30 times in a diesel injector; and a rate of increase in kinematic viscosity at 40° C. ranging from 33% to 41% when the lubricating oil composition is subjected to high temperature oxidation according to the method NOACK (250° C., 4 hrs).

20. The lubricating oil composition according to claim 16, wherein:

the mononuclear molybdenum compound is a compound of formula (III), a compound of formula (IV), or a mixture thereof:

(III)

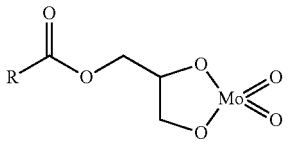

-continued (IV)

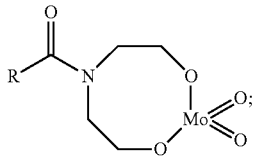

and

R represents a fatty oil residue of a fatty acid comprising at least 12 carbon atoms.

* * * * *